US006463894B2

(12) United States Patent
Hasler et al.

(10) Patent No.: US 6,463,894 B2
(45) Date of Patent: Oct. 15, 2002

(54) PORTABLE INTERNAL COMBUSTION-ENGINED TOOL AND METHOD OF FORMING A GAS MIXTURE IN THE TOOL COMBUSTION CHAMBER

(75) Inventors: Roland Hasler, Vaduz (LI); Kaveh Towfighi, Sigmarszell (DE)

(73) Assignee: Hilti Aktiengesellschaft, Schaan (LI)

( * ) Notice: Subject to any disclaimer, the term of this patent is extended or adjusted under 35 U.S.C. 154(b) by 7 days.

(21) Appl. No.: 09/741,281

(22) Filed: Dec. 19, 2000

(65) Prior Publication Data

US 2001/0006044 A1 Jul. 5, 2001

(30) Foreign Application Priority Data

Dec. 23, 1999 (DE) ..... 199 62 597

(51) Int. Cl.[7] ..... B25C 1/08; F02B 71/04

(52) U.S. Cl. ..... 123/46 R; 227/10; 123/275; 123/46 H

(58) Field of Search ..... 123/260, 267, 123/268, 280, 286, 46 R, 46 A, 46 H, 37, 38, 39, 274, 275; 227/10, 11

(56) References Cited

U.S. PATENT DOCUMENTS 5,213,247 A * 5/1993 Gschwend et al. ..... 227/10
6,041,603 A * 3/2000 Phillips ..... 60/632

* cited by examiner

*Primary Examiner*—Gene Mancene
*Assistant Examiner*—Arnold Castro
(74) *Attorney, Agent, or Firm*—Sidley Austin Brown & Wood, LLP

(57) ABSTRACT

An internal combustion-engined tool including a piston and a combustion chamber (1) for generating power for driving the piston and having a bottom (3) adapted to receive the piston plate (9), an end wall (17) located opposite the bottom (3), a movable wall (14) located between the bottom (3) and the end wall (17) and provided with an opening element **(14*a*), a movable separation wall (18) located between the bottom (3) and the movable wall (14) and provided with a plurality of openings (38), and an arrangement (42, 43) for injecting fuel gas into a space formed between the end wall and the movable wall upon the movable wall (14) and the separation wall (18) being displaceable in a direction of the bottom (3) upon collapsing of the combustion chamber (1)**.

9 Claims, 3 Drawing Sheets

PORTABLE INTERNAL COMBUSTION-ENGINED TOOL AND METHOD OF FORMING A GAS MIXTURE IN THE TOOL COMBUSTION CHAMBER

BACKGROUND OF THE INVENTION

1. Field of the Invention

The present invention relates to a portable internal combustion-engined tool and a method of forming a gas mixture in the tool combustion chamber. In particular, the present invention relates to a setting tool for driving-in fastening elements.

2. Description of the Prior Art

A tool and a method, which are referred to above, are described in a German Publication No. 199 50 352. In the tool, the combustion chamber can be brought into a collapsible condition when chamber walls provided therein and limiting chamber sections are displaced in a direction toward the chamber bottom and lie one upon another, whereby an expandable space is formed in the combustion chamber which is located, in a direction of displacement of the limiting walls, behind the last displaceable wall.

The tool described in the German publication includes a piston having a piston plate, and a combustion chamber for generating power for driving the piston and having a bottom adapted to receive the piston plate, an end wall located opposite the bottom, a movable wall located between the bottom and the end wall and provided with a check valve, a movable separation wall located between the bottom and the movable wall and provided with a plurality of openings, with the movable wall and the separation wall being displaceable in a direction of the bottom upon collapsing of the combustion chamber. In the side wall of the combustion chamber, there is provided means for feeding fuel gas thereinto.

The fuel gas is fed during the expansion of the chamber sections and actually shortly before they reach their completely expanded condition. Immediately thereafter, ignition takes place. As a result, the fed fuel gas has little time for homogeneous or uniform distribution in the combustion chamber. When the fuel gas is fed in a liquified state, a danger exists that the fuel gas would not evaporate completely. In both cases, the operating efficiency of the tool is reduced.

Accordingly, an object of the present invention is to provide a tool and a method which would insure a homogeneous distribution of the fuel gas in the combustion chamber.

SUMMARY OF THE INVENTION

This and other objects of the present invention, which will become apparent hereinafter, are achieved by feeding fuel gas into the expandable space which is formed behind the movable wall when the movable wall is displaced in the direction toward the chamber bottom.

The fuel gas can be fed into the expandable space shortly after the combustion chamber starts to collapse, when the expandable space has not yet expanded completely, or upon the complete expansion of the expandable space.

According to a preferred embodiment of the present invention, a check valve is provided in the end wall of the combustion chamber for admitting fresh air thereinto. The fresh air is aspirated into the expandable space upon collapsing of the combustion chamber. The check valve in the end wall at the same time prevents leakage of the fuel gas outside.

The fuel gas can be injected in a liquified form, gaseous form, or an already available air-fuel gas mixture can be injected.

In the collapsible condition of the combustion chamber, in the rear portion of the chamber, i.e., in the expandable space, a fresh air is present. Simultaneously or shortly after the tool has been pressed against an object, in which a fastening element has to be driven in, the fuel gas is injected into the expandable space, and the chamber sections begin to expand as a result of displacement of the movable walls. The fuel gas is mixed with air only in the rear space and flows into the respective chamber sections through openings provided in the movable walls. At that, the gas flow is deflected to provide for a better intermixing of the air-fuel gas mixture. Upon the complete expansion of the chamber sections and the reduction of the rear space practically to zero, the entire air-fuel gas mixture is available in the combustion chamber section and, thus, can be ignited. As a result of good or homogeneous intermixing of the air-fuel gas mixture, the combustion is characterized by a high efficiency which leads to a high energy release. When a liquified fuel gas in injected, there is sufficient time available for its evaporation as the ignition does not take place shortly after the injection but only after the complete expansion of the chamber sections. This further contributes to the increased efficiency of the tool.

According to a preferred embodiment of the present invention, as discussed above, a check valve is provided in the combustion chamber end wall, so that a fresh air is always aspirated into the combustion chamber as it collapses.

When the combustion chamber collapses, the residual gases are expelled through a check valve provided in the combustion chamber bottom. A still further check valve is provided in the combustion chamber movable wall, which faces the stationary end wall. This check valve provides for flow of the air-fuel gas mixture from the rear space into the expandable chamber sections but prevents flow of the residual gases from the chamber sections into the rear space.

According to further development of the present invention, the separation wall has an upwardly extending lug provided at its free end with a shoulder. The movable wall has a hollow extension which surrounds the lug of the separation wall. Both the separation wall lug and the movable wall extension extend through the end plate. A seal is provided between the movable wall extension and the wall of the opening in the end wall, through which the lug and the extension extend, in order to prevent any leakage of the air-fuel gas mixture. The movable wall extension and the separation wall lug are provided to insure displacement of the separation wall upon displacement of the movable wall. The distance between the end surface of the extension and the lug shoulder defines the distance between the movable wall and the separation wall and thereby the size of the forechamber section.

The fuel gas feeding means can be connected with a single metering valve. The metering valve can be set for a large amount which improves the metering precision. A standard valve can be used as a metering valve, which reduces the cost of the tool. The metering valve can be connected with the combustion chamber by one or several feeding channels or conduits.

Means is provided to insure the injection of the fuel gas at the beginning of the setting process to provide sufficient time for the liquified gas to evaporate. Eventually, an electronic control can be used to prevent ignition before expiration of certain time.

The novel features of the present invention, which are considered as characteristic for the invention, are set forth in the appended claims. The invention itself, however, both as to its construction and its mode of operation, together with additional advantages and objects thereof, will be best understood form the following detailed description of preferred embodiments, when read with reference to the accompanying drawings.

DETAILED DESCRIPTION OF THE PREFERRED EMBODIMENT

Figure 1:
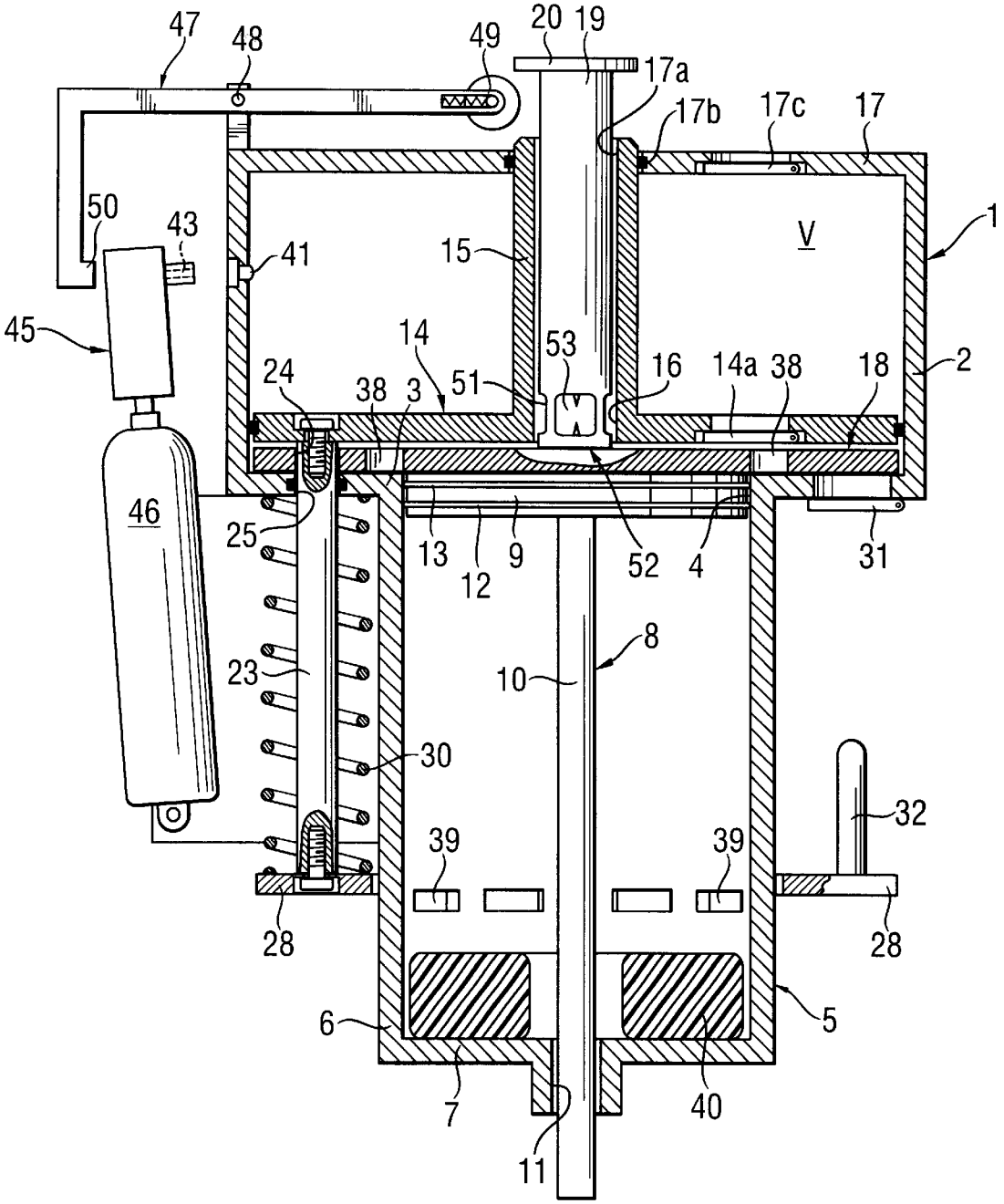
FIG. 1. an axial cross-sectional view of a tool according to the present invention in a position in which the combustion chamber section just starts to expand and a liquified gas is injected into the rear portion of the combustion chamber.

FIG. 1 shows an axial cross-sectional view of an internal combustion-engined tool for driving in fastening elements according to the present invention in the region of its combustion chamber with internal space V in a completely expanded condition.

As shown in FIG. 1, the setting tool has a cylindrical combustion chamber 1 with a cylindrical wall 2 and an annular bottom 3 with a central opening 4. A guide cylinder 5, which has a cylindrical wall 6 and a bottom 7, adjoins the opening 4 in the bottom 3 of the combustion chamber 1. A piston 8 is displaceably arranged in the guide cylinder 5. The piston 8 consists of a piston plate 9 facing the combustion chamber 1 and a piston rod 10 extending from the center of the piston plate 9. The piston rod 10 projects through an opening 11 formed in the bottom 7 of the guide cylinder 5.

FIG. 1 shows a non-operational position of the setting tool in which the piston 8 is in its rearward off-position. The side of the piston plate 9 adjacent to the bottom 3 of the combustion chamber 1 is located closely adjacent to the bottom 3, with the piston rod 10 projecting only slightly beyond the bottom 7 of the guide cylinder 5. For sealing the cylinder chambers on opposite sides of the piston plate 9 for each other, sealing rings 12, 13 are provided on the outer circumference of the piston plate 9.

Inside of the combustion chamber 1, there is provided a cylindrical plate 14 further to be called a movable combustion chamber wall or movable wall. The movable wall 14 is displaceable in the longitudinal direction of the combustion chamber 1. For separating the chambers on opposite sides of the movable wall 14, an annular sealing is provided on the circumference of the movable wall. The movable wall 14 has a central opening 16.

Between the movable wall 14 and the annular bottom 3 of the combustion chamber 1, there is provided a separation plate 18. The separation plate 18 likewise has a circular shape and an outer diameter corresponding to the inner diameter of the combustion chamber 1. The side of the separation plate 18 adjacent to the movable wall 14 is provided with a cylindrical lug 19 that projects through the central opening 16 in the movable wall 14.

In the central opening 16 of the movable wall 14, there is provided a circumferential or annular sealing sealingly engaging the outer circumference of the cylindrical lug 19. At its free end, the cylindrical lug 19 is provided with a shoulder 20 the outer diameter of which exceeds the inner diameter of the opening 16 of the movable wall 14. The movable wall 14 has, at its side remote from the separation plate a hollow cylindrical extension 15 the inner diameter of which corresponds to the inner diameter of the opening 16. The hollow cylindrical extension 15 is coaxial with the opening 16 and concentrically surrounds the lug 19. The free end of the extension 15 is spaced a predetermined distance from the annular shoulder 20. The lengths of both the cylindrical lug 19 and the cylindrical extension 15 of the movable wall 14 are so selected that they extends through an end wall 17 of the combustion chamber 1, which closes the combustion chamber 1 at its side remote from the piston 8, in any position of the movable wall 14. Both the cylindrical extension 15 and the cylindrical lug 19 project through the opening 17*a* in the end wall 17. An annular seal 17*b*, which is provided in the wall of the opening 17*a*, sealingly engages the extension 15. The seal 17*b* prevents leakage of fuel gas from the combustion chamber 1 outside through the opening 17*a*.

In the end wall 17, there is provided a check valve 17*c* that permits only flow of air into the combustion chamber 1 but prevents any flow from the combustion chamber. Another check valve 14*a* is provided in the movable wall 14. The check valve 14*a* enables flow only in a direction toward the separation plate 18 but not in the opposite direction. The separation plate 18 has a plurality of through openings 38 arranged along a concentric path at the same distance form the axis of the combustion chamber 1. A third check valve 31 is provided in the bottom 3 of the combustion chamber 1. The check valve 31 provides for gas flow form the combustion chamber 1 outside but prevents any flow in opposite direction.

For displacing the movable wall 14, there are provided several, e.g., three drive rods 23 uniformly distributed along the circumference of the movable wall 14 and fixedly connected therewith. Only one of the drive rods 23 is shown in FIG. 1. The drive rods 23 extend parallel to the axis of the combustion chamber 1 and outside of the cylindrical wall 6 of the guide cylinder 5. The drive rods 23 extend through openings 24, respectively, formed in the separation plate 18 and through corresponding openings 25 formed in the bottom 3 of the combustion chamber 1. Each of the openings 25 is provided win a circumferential seal located in the surface defining the opening 25 for sealing the combustion chamber 1 from outside. The movable wall 14 is connected with drive rods 23 by, e.g., screws 27 which extend through the movable wall 14 and are screwed into the drive rods 23. The free ends of the drive rods 23 are connected with each other by a drive ring 28 which is arranged concentrically with the combustion chamber axis and which circumscribes the guide cylinder 5. The drive ring 28 is connected with the drive rods 23 by screws which extend through the drive ring 28 and are screwed into the drive rods 23 through end surfaces of the free ends of respective drive rods 23. Each of the drive rods 23 supports a compression spring 30 extending between the bottom 3 of the combustion chamber 1 and the drive ring 28. The compression springs 30 are designed for pulling the movable wall 14 toward the bottom 3.

Figure 2:
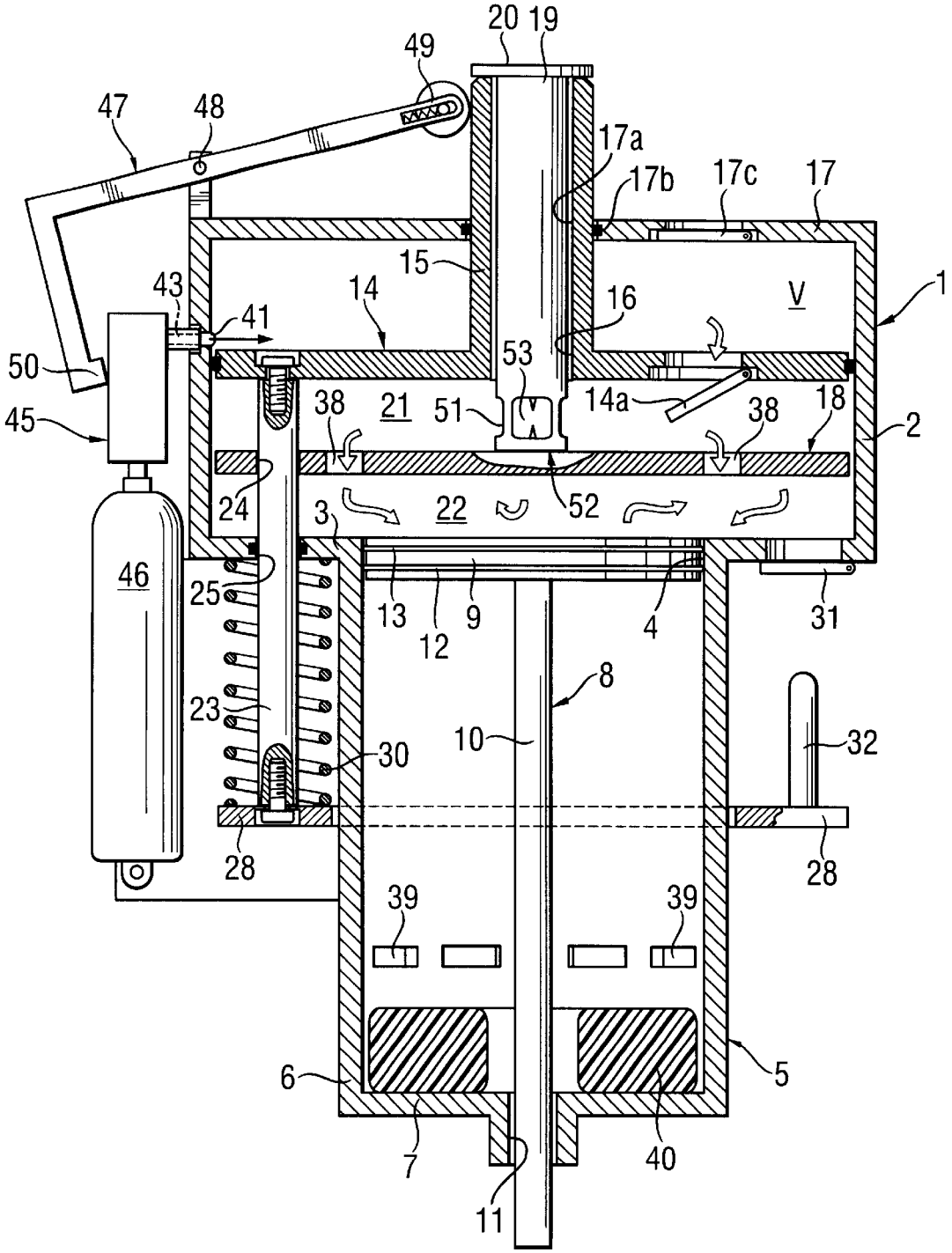
FIG. 2. a cross-sectional view similar to that of FIG. 1 but with the combustion chamber sections expanded to a greater extent.
Figure 3:
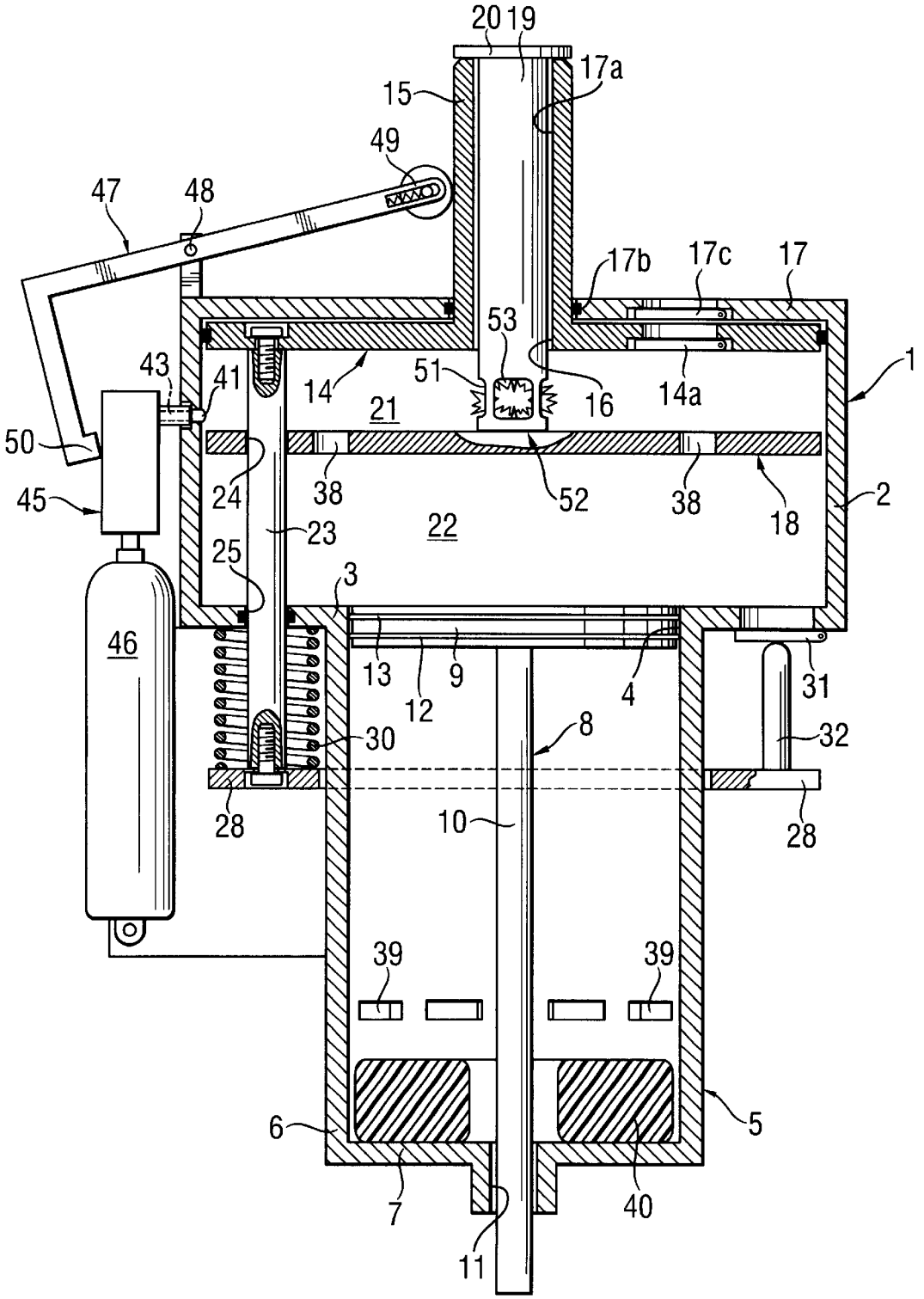
FIG. 3. a cross-sectional view similar to that of FIGS. 1–2 but with completely expanded combustion chamber sections at a time point of ignition.

The drive ring 28 is provided, in its region beneath the check valve 31, with a stop 32 which prevents opening of the check valve 31 in a position of the movable wall 14 in which it is spaced from the bottom 3 of the combustion chamber 1 by a greatest distance and is in its locking position. The locking position of the movable wall 14 is defined by a locking position of the drive ring 28 when the drive ring is displaced into a predetermined end position thereof upon the tool being pressed against an object. In this position, the stop 32 blocks the checking valve 31, preventing its opening. Thus, upon the tool being pressed against an object, the drive ring 28 is displaced toward the bottom 3 of the combustion chamber 1, and the drive rods 23 displace the movable combustion chamber wall 14 toward the end wall 17. After the movable wall 14 travels a certain distance, the. hollow cylindrical extension 15 abuts from beneath the annular shoulder 20, and the separation plate 18 is carried with the movable wall 14. This position of the combustion chamber wall 14 and the separation plate 18 is shown in FIG. 2. In this position, there are formed a forechamber section 21 between the movable wall 14 and the separation plate 18 and a main chamber section 22 between the separation plate 18 and the combustion chamber bottom 3. The space V between the end wall 17 and the movable wall 14 is reduced. The movable wall 14 and the separation plate 18 are displaced until the movable wall 14 reaches its locking position which is defined by the locking position of the drive ring 28. This position is shown in FIG. 3. In this position, the movable wall 14 abuts the end wall 17. The forechamber section 21 and the main chamber section 22 are expanded to their maximum possible extend, and the space V between the movable wall 14 and the end wall 17 is reduced practically to zero.

At the lower end of the guide cylinder 5, there are provided openings 39 for letting air out of the guide cylinder 5 upon movement of the piston 8 toward the guide cylinder bottom 7. At the lower end of the guide cylinder 5, there is also provided damping means 40 for damping the movement of the piston 8. As soon as the piston 8 passes the openings 39, the waste gases are expelled from the guide cylinder 5 through the openings 39.

The cylindrical wall 2 of the combustion chamber 1 has, in the vicinity of the combustion chamber end wall 17, a radial opening 41. The opening 41 communicates via a feed channel 43 with a metering head 45 having a metering valve, not shown. A liquefied gas is delivered to the metering head 45 from a flask 46. The liquefied gas flows from the metering head 45 through the feed channel 43 into the opening 41 when the metering head 45 is pressed toward the cylindrical wall 2 of the combustion chamber 1. The cross-section of the radial opening 41 is reduced in a direction toward the combustion chamber 1, with the transitional surface serving as a stop for the feed channel 43. The pressing of the metering head 45 toward the cylindrical wall 2 is effected with a stirrup 47 which is pivotally supported on the cylindrical wall 2 at a pivot point 48. A free end of the cylindrical extension 15 engages the end 49 of the stirrup 47 when the movable wall 14 moves in a direction toward the end wall 17. The cylindrical extension 15 lifts the end 49, pivoting the stirrup 47 in the counterclockwise direction about the pivot point 48. Upon pivotal movement of the stirrup 47, the other end 50 thereof presses the metering head 45 toward the cylindrical wall 2. This process starts already at the beginning of the movable wall 14. The metering head 45 and the flask 46 form a unitary assembly and are permanently connected with each other. The system metering head 45-flask 46 can, e.g., can be titled about an axle provided in the bottom region of the flask 46.

As discussed above, FIG. 3 shows a completely expanded condition of the combustion chamber 1, i.e., with the forechamber section 21 and the main chamber section 22 being completely expanded and the space V reduced practically to zero. The feed channel or conduit 43 is pressed toward the cylindrical wall 2, and the metering valve is open, discharging its content into the forechamber section 21. The movable plate 14 is in its locked position, and the check valve is blocked by the stop 32. The tool is ready for ignition.

To provide for ignition, the cylindrical lug 19 is formed, in its region adjacent to the separation plate 18, as an ignition cage 51 in which an ignition section 21. The ignition element 52 is located in the central region of the ignition cage 51 which is provided with a plurality of circumferential openings 53 through which a laminar flame front can exit from the ignition cage 51 into the forechamber section 21. The openings 53 can, e.g., be uniformly distributed over the circumference of the cylindrical lug 19. They become free when the movable wall 14 is displaced with respect to the separation plate 18, at the start of the process, so that it engages from beneath the annular shoulder 20 of the lug 19.

Below, the operation of the setting tool, shown in FIGS. 1–2, will be described in detail.

FIG. 1 shows the condition of the combustion chamber 1 in the off position of the setting tool. The combustion chamber 1 is completely collapsed, with the separation plate lying on the bottom 3 of the combustion chamber 1 and the movable wall 14 lying on the separation plate 18. In order to distinguish the wall 14 and the plate 18, for the clarity sake, they are shown slightly separated. The piston 8 is in its rearward off-position so that practically no space remains between the piston 8 and the separation plate 18 if one would disregard a small clearance therebetween. The position, in which the movable wall 14 lies on the separation plate 18, results from the compressing spring 30 biasing the drive ring 28 away from the bottom 3, and the ring 28 pulls with it the movable wall 14 via the drive rods 23. In this position, the drive ring 28 and the stop 32 are spaced from the check valve, so that the check valve 32 remains closed. The system metering head 45-flask 46 is pivoted away from the wall 2 of the combustion chamber 1, with the metering valve being closed.

When in this condition, the setting tool is pressed with its front point against an object, the fastening element should be driven in, a mechanism, not shown, applies pressure to the drive ring 28 displacing it in the direction of the bottom 3 of the combustion chamber 1. This takes place simultaneously with the setting tool being pressed against the object. Upon displacement of the drive ring 28 toward the bottom 3, the movable wall. 14 is lifted of the separation plate 18 with the cylindrical extension 15 displacing together with the movable wall 14. The free end of the extension 15 engages the end 49 of the stirrup 47, pivoting the stirrup 47 counterclockwise about the pivot point 48, so that the other end 50 of the stirrup 47 presses the metering head 45 toward the combustion chamber wall 2. The feed channel 43 is pressed into the opening 42, and is displaced inward, opening the metering valve. This leads to the injection of the liquefied fuel gas into the space V of the combustion chamber 1. Thus, the injection of the fuel gas into the space V takes place already at an early stage of the process, after the start of the displacement of the movable wall 14.

Upon further displacement of the movable wall 14 in a direction toward the end wall 17, the check valves 17*c* and 31 remain closed, while the check valve 14*a* is open. The air-fuel gas mixture, thus, can flow from the space V between the end wall 17 and the movable wall 14 into the forechamber section 21 between the movable wall 14 and the separation plate 18 through the check valve 14*a*.

Upon further displacement of the movable wall 14 in a direction toward the end wall 17, the end of the cylindrical extension 15 engages from beneath the shoulder 20 of the lug 19, lifting the lug 19, together with the separation plate 18, whereby the separation plate 18 is lifted from the bottom 3. Now, the air-fuel gas mixture can flow through the opening 38 in the separation plate 18 into the main chamber section 22 which starts to expand. At this point in time, the forechamber section 21 is already in its completely expanded condition. This position is shown in FIG. 2.

From this point in time, the movable wall 14 is displaced together with separation wall 18 until the movable wall 14 abuts the end wall 17 and the drive ring 28 becomes locked. The further displacement of the movable wall 14 is, thus, blocked. In this position, the main chamber section 22 is also in its completely expanded condition, and the space between the movable wall 14 and the end wall 17 is reduced practically to zero. As a result of movement of the movable wall 14 and the separation plate 18, the initially injected in the combustion chamber, liquefied fuel gas, upon penetrating through the check valve 14*a* and the openings 38 into the forechamber section 21 and the main chamber 22, respectively, is mixed up further, so that soon in the entire combustion chamber 1, in both chambers sections 21, 22, a homogeneous air-fuel gas mixture becomes available. This condition of the combustion chamber is shown, as discussed, in FIG. 3. The feed channel 43 extends into the radial opening 41, and the metering valve is open. This, however, is of no consequences, as the metering valve is empty and its inlet is closed. The check valve 31 is closed by the stop 32 that prevents the check valve 31 from opening.

Upon actuation of a pull lever, a trigger, or the like of the tool, an ignition process is initiated, with the movable wall 14, the separation plate 18, and the drive ring 28 being locked in their positions. Shortly thereafter, ignition, spark is generated by the actuation of the ignition element 52 inside the cage 51. A mixture of air and the fuel gas, which was formed in each of the chamber sections 21 and 22, is ignited. First, the mixture starts to burn aminary in the forechamber 21, and the flame front spreads with a relatively low speed in a direction of the openings 38. No gas can flow back through the check valve 14*a*. It is closed. The unconsumed air-fuel gas mixture is displaced ahead and enters, through the openings 38, the main chamber section 22, creating there turbulence and pre-compression. When the flame front reaches the openings 38; it enters the main chamber section 22, due to the reduced cross-section of the openings 38, in the form of flame jets, creating there a further turbulence. The thoroughly mixed, turbulent air-fuel gas mixture in the main chamber section 22 is ignited over the entire surface of the flame jets. It bums with a high speed which significally increases the combustion efficiency.

The combustible mixture impacts the piston 8, which moves with a high speed toward the bottom 7 of the guide cylinder 5, forcing the air from the guide cylinder 5 out through the openings 39. Upon the piston plate 9 passing the openings 39, the exhaust gas is discharged therethrough. The piston rod 10 effects setting of the fastening element. After setting or following the combustion of the air-fuel gas mixture, the piston 8 is brought to its initial position, which is shown in FIG. 3, as a result of thermal feedback produced by cooling of the flue gases which remain in the combustion chamber 1 and the guide cylinder 5. As a result of cooling of the flue gases, an underpressure is created behind the piston 8 which provides for return of the piston 8 to its initial position. The combustion chamber 1 should remain sealed until the piston 8 reaches its initial position.

After return of the piston 8 to its initial position, the movable wall 14 and the separation plate 18 are unlocked. The compression springs 30 bias the drive ring 28 away from the bottom 3 of the combustion chamber 1, and the drive ring 28, together with the stop 32, move downward, with the stop 32 releasing the check valve 31. Upon further displacement, the drive ring 28 pulls, via the drive rods 23, the movable wall 14 in a direction toward the bottom 3. Later, the separation plate 18 is displaced downwardly, by the movable wall 14 which abuts the separation plate 18. Upon movement of the movable wall 14 and the separation plate 18 toward the bottom 3, the exhaust gases in the forechamber section 21 are pushed through the openings 38 in the separation plate 18 into the main chamber 22 and therefrom, together with the exhaust gases formed in the main chamber 22, through the open check valve 31 outside. The check valve 14*a* is closed during this movement. At the same time, the space V between the movable wall 14 and the end wall 17 begins to expand. This results in opening of the check valve 17*c* and to the flow of the fresh air into the combustion chamber 1, i.e., into the space V between the end wall 17 and the movable wall 14. Finally, the separation plate 18 abuts the bottom 3, lying thereon, with the movable wall 14 lying on the separation plate 18. Thus, the combustion chamber 1 has completely collapsed and become free of waste gases, with the entire expanded space V between the end wall 17 and the movable wall being filled with the fresh air. Meanwhile, the stirrup 47 pivots away from the metering head 45, being released as a result of movement of the cylindrical extension 15, together with movable wall 14 downwardly. This results in the movement of the feed channel 43 out of the metering head, whereby the outlet of the metering valve in the metering head 45 becomes closed, opening the inlet valve. The liquefied gas can now flow from the flask 46 into the metering valve, filling it with the fuel gas. The process can now be started again, accompanied by the injection of the fuel gas and formation of a homogeneous air-fuel gas mixture.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. An internal combustion-engined tool, comprising a piston having a piston plate (9); and a combustion chamber (1) for generating power for driving the piston and having a fixed bottom (3) adapted to receive the piston plate (9), an end wall (17) located opposite the fixed bottom (3), a movable wall (14) located between the fixed bottom (3) and the end wall (17) and provided with a check valve (14*a*), a movable separation wall (18) located between the fixed bottom (3) and the movable wall (14) and provided with a plurality of openings (38), the movable wall (14) and the separation wall (18) being displaceable in a direction of the fixed bottom (3) upon collapsing of the combustion chamber (1) with formation of an expandable space (V) between the movable wall (14) and the end wall (17) during displacement of the movable wall (14) in the direction toward the fixed bottom (3), and means for feeding fuel gas into the expandable space (V).

2. A tool according to claim 1, further comprising at least one further check valve (17*c*) provided in the end wall (17).

3. A tool according to claim 1, wherein the separation plate (18) has a lug (19) provided, at a free end thereof with a shoulder (20), and wherein the movable wall (14) has a hollow extension (15) surrounding the lug (19), with both the lug (19) and the extension (15) extending through the end wall (17).

4. A tool according to claim 1, wherein the feeding means comprises single metering means.

5. A method of providing a combustible gas mixture in a combustion chamber of an internal combustion-engined tool and having movable walls (14, 18) limiting two chamber sections (21, 22) and provided with openings (14*a*, 38) therethrough, the method comprising the steps of displacing the movable walls (14, 18) in a direction toward a combustion chamber bottom (3), whereby a combustion chamber space (V) lying between an end wall (17) of the combustion chamber (1) opposite the bottom (3) and a movable wall (14) facing the end wall (17) expands; feeding the fuel gas into the combustion chamber space (V); and feeding fresh air through the end wall (17) of the combustion chamber located opposite the combustion chamber bottom (3) during displacement of the movable walls (14, 18) in the direction toward the bottom (3).

6. A method of providing a combustible gas mixture in a combustion chamber of an internal combustion-engined tool and having movable walls (14, 18) limiting two chamber sections (21, 22) and provided with openings (14*a*, 38) therethrough, the method comprising the steps of displacing the movable walls (14, 18) in a direction toward a combustion chamber bottom (3), whereby a combustion chamber space (V) lying between an end wall (17) of the combustion chamber (1) opposite the bottom (3) and a movable wall (14) facing the end wall (17) expands; feeding the fuel gas into the combustion chamber space (V); and expanding the chamber sections (21, 22) during which step the fuel gas flows from the space (V) behind the movable wall 14 into the chamber sections (21, 22).

7. A method according to claim 6, comprising the step of igniting the fuel gas after collapse of the space (V) behind the movable walls (14, 18) resulting from expansion of the chamber sections (21, 22).

8. A method of providing a combustible gas mixture in a combustion chamber of an internal combustion-engined tool and having a fixed bottom (3) and movable walls (14, 18) limiting two chamber sections (21, 22) and provided with openings (14*a*, 38) therethrough, the method comprising the steps of displacing the movable walls (14, 18) in a direction toward the fixed bottom (3), upon collapsing of the combustion chamber, whereby a combustion chamber space (V) lying between an end wall (17) of the combustion chamber (1) opposite the bottom (3) and a movable wall (14) facing the end wall (17) expands; and feeding the fuel gas into the expanded combustion chamber space (V).

9. A method according to claim 8, wherein the feeding step includes feeding the fuel gas in a liquefied form.

* * * * *